United States Patent [19]

Haruta et al.

[11] 4,098,785

[45] Jul. 4, 1978

[54] THERMOPLASTIC DUPLICATION PLATE MAKING METHOD

[75] Inventors: Yasuo Haruta, Nishinomiya; Kazumasa Nagasoe, Osaka; Norio Shiga, Neyagawa; Ikuo Morino, Toyonaka; Nobuo Aisu, Osaka, all of Japan

[73] Assignee: Nippon Paint Co., Ltd., Osaka, Japan

[21] Appl. No.: 699,049

[22] Filed: Jun. 23, 1976

[30] Foreign Application Priority Data

Aug. 13, 1975 [JP] Japan ..... 50-98943

[51] Int. Cl.[2] ..... B41C 3/06

[52] U.S. Cl. ..... 264/220; 101/401.1; 264/25; 264/293; 264/322

[58] Field of Search ..... 264/25, 220, 293, 322; 425/363, 373; 101/401.1

[56] References Cited

U.S. PATENT DOCUMENTS

| | | | |
|---|---|---|---|
| 2,496,014 | 1/1950 | Myers | 425/363 X |
| 2,825,094 | 3/1958 | Zeigler | 264/25 |
| 3,874,836 | 4/1975 | Johnson | 264/293 X |

*Primary Examiner*—Thomas P. Pavelko
*Attorney, Agent, or Firm*—Wenderoth, Lind & Ponack

[57] ABSTRACT

A method of manufacturing thermoplastic duplication plates having a relief image transcribed thereto from a matrix which has a relief pattern in complemental relation to the transcribed relief image. To this end, a thermoplastic resin sheet is fed onto a rotating cylinder heated to a predetermined temperature and is then transported towards a transcription station carried by the rotating cylinder while it clings to the outer peripheral surface of the cylinder. At the transcription station, the thermoplastic resin sheet then heated to a semi-fluidized state is registered or aligned with the matrix being moved in a linear direction substantially tangential to the outer peripheral surface of the cylinder. During passage through the transcription station, the thermoplastic resin sheet is transferred onto the matrix with the material penetrating deep into indentations in the matrix. Therefore, the thermoplastic resin sheet is cooled and subsequently separated from the matrix, thereby completing the thermoplastic duplication plate.

9 Claims, 1 Drawing Figure

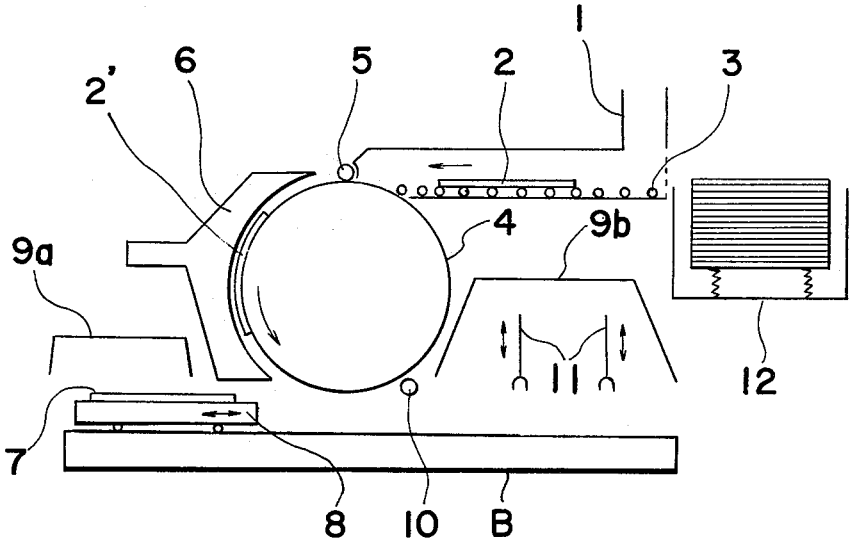
1
2'
6
5
2
3
4
9b
9a
11
12
7
8
10
B

THERMOPLASTIC DUPLICATION PLATE MAKING METHOD

The present invention generally relates to the art of production of thermoplastic duplication plates and, more particularly, to a method of manufacturing thermoplastic duplication plates each having a relief image transcribed thereto from a matrix which is made of paper material and has a relief pattern in complemental relation to the transcribed relief image on the thermoplastic duplication plate.

The method referred to above and to which the present invention also pertains is disclosed, for example, in the Japanese Patent Publication (Examined) No. 12933/73 published for opposition on Apr. 24, 1973. According to the Japanese Patent Publication as numbered above, the method comprises transporting a thermoplastic resin sheet through a heating furnace by means of a substantially endless metallic conveyor belt with a releasing paper medium interposed between the thermoplastic resin sheet and the conveyor belt. The thermoplastic resin sheet is prepared from polyethylene or polypropylene and is fed in the form of either a web of the rolled thermplastic resin sheet or as cut in a predetermined or desired length. The thermoplastic resin sheet is, during the passage thereof through the heating furnace, allowed to substantially melt or become pliable to an extent that the thermoplastic resin constituting the thermoplastic resin sheet can penetrate during the subsequent transcription process into cavities which define a relief pattern on the paper matrix. The thermoplastic resin sheet emerging from the heating furnace is then passed through a clearance defined between a water-cooled press roll and a water-cooled back-up roll, said press roll having the paper matrix fixedly mounted on the outer peripheral surface thereof. Transcription of the relief pattern on the paper matrix to the thermoplastic resin sheet so plasticized is carried out during the passage of the thermoplastic resin sheet through the clearance betweem the press and back-up rolls, a complete duplication plate being subsequently obtained after the thermoplastic resin sheet has been separated from the paper matrix.

The Japanese Patent Publication as numbered above also discloses an apparatus for manufacturing the thermoplastic duplication plates, which comprises some components necessary to perform the above described method in sequence.

The method and apparatus of the Japanese Patent Publication as numbered above is satisfactory in the continuous production of the thermoplastic duplication plates for use as printing plates utilizable in printing newspapers or the like printed materials of a nature being issued in a large number and required to be available to readers or those interested. However, the following disadvantages have been found:

(1) Since the paper matrix is curved, as attached to the outer peripheral surface of the press roll, during the transcription of the relief pattern on the paper matrix to the thermoplastic resin sheet then plasticized, reproduction of the details is insufficient and the resultant duplication plate is also so curved that the subsequent processing, such as trimming for removing fins present at peripheral edges of the duplication plate, is complicated. (2) Since the metallic conveyor belt is employed in a substantially endless form for transporting the thermoplastic resin sheet and is, therefore, alternatively heated and cooled as it repeatedly passes through and emerges from the heating furnace, not only does the conveyor as a whole be complicated and bulky in size, but also the conveyor belt is susceptible to reduction in durability. (3) Since the transportation of the thermoplastic resin sheet through the heating furnace and then through the clearance between the press and back-up rolls is carried out while the thermoplastic resin sheet is mounted on one run of the metallic conveyor belt through a corresponding run of the releasing paper medium, which is also substantially endless and is driven externally of the metallic conveyor belt and which is used for avoiding sticking of the thermoplastic resin sheet to the conveyor belt and also any possible frictional displacement which may otherwise occur between the metallic conveyor belt and the thermoplastic resin sheet during the transportation, synchronization of the peripheral velocity of the press roll and the velocity of movement of that run of the conveyor belt, which is necessary to have either the thermoplastic resin sheet or the paper matrix registered with the other during the passage of the thermoplastic resin sheet through the clearance together with the releasing paper medium, can hardly be achieved. Therefore, not only does the paper matrix used tend to be damaged because of friction present between the paper matrix and the thermoplastic resin sheet, but also the resultant duplication plate tends to have a varying thickness over the length thereof.

In view of the above described disadvantages inherent in the conventional duplication plate making method and apparatus, the inventors have successfully made every effort to develope a similar method which substantially eliminates the above described disadvantages and which does not require the use of any transportion belt for transporting the thermoplastic resin sheet which is heated to a temperature where the latter is so soft that, if any transportation belt is otherwise employed, the thermoplastic resin sheet may cling thereto, the matrix being, however, reciprocally moved in a linear direction in the form of a plate-like shape without being curved or deformed even during a period in which the transcription of the relief pattern on the paper matrix to the thermoplstic resin sheet takes place.

More specifically, the method successfully developed by the inventors for the purposes of the present invention makes use of a temperature adjustable press roll for transporting the thermoplastic resin sheet towards a transfer station where the thermoplastic resin sheet is pressed to and transferred onto the matrix with the relief pattern on the paper matrix transcribed to the thermoplastic resin sheet. This is possible because the the press roll and, more particularly, the outer peripheral surface of the press roll, is heated to a temperature sufficient to allow the thermoplastic resin sheet to become so soft, or so substantially melted, as to cling to the outer peripheral surface of the press roll upon contact of the thermoplastic resin sheet with said outer peripheral surface of said press roll.

During the transportation of the thermoplastic resin sheet towards the transfer station while said resin sheet clings to the outer peripheral surface of the press roll being rotated, the thermoplastic resin sheet may be further heated by an external heating source, positioned externally of and adjacent the press roll, to a temperature sufficient to cause the thermoplastic resin sheet on the outer peripheral surface of the press roll to substantially melt, in cooperation with the heat transmitted thereto from the press roll, the readiness for the thermoplastic resin sheet to penetrate into identations or cavities in the paper matrix during the subsequent transcription process, which indentations or cavities form the relief pattern on the matrix.

The thermoplastic duplication making method of the present invention also makes use of a reciprocally linearly movable platen for the support of the matrix thereon, which movable platen is supported on a bench for reciprocal movement in a direction substantially tangential to the outer periphery of the press roll, but spaced a predetermined distance therefrom. The platen is preferably of a box-like construction having a perforated flat support on which the matrix is steadily mounted by the effect of a suction force developed in the interior chamber of the platen and acting on the matrix through perforations in the flat support surface.

The movable platen and the press roll are so synchronized that the thermoplastic resin sheet clinging to the outer peripheral surface of the press roll being rotated can be registered at the transfer station with the matrix on the reciprocally movable platen then being moved from a stand-by position towards an operated position, the transcription process being thereby performed. The platen is preferably water-cooled and, therefore, the thermoplastic resin sheet so transferred from the press roll onto the matrix on the platen is cooled within a reasonably short period of time. Transfer of the thermoplastic resin sheet from the press roll onto the platen, while the outer peripheral surface of the press roll is substantially mirror-polished or otherwise smoothened, is considered to take place by the effect of a difference in temperature between the press roll and the matrix. Therefore, the platen may not always have a water-cooled construction, but the water-cooled construction may be considered to facilitate the transfer of the thermoplastic resin sheet from the press roll onto the platen because of forced cooling of the matrix in contact with the platen.

In order to ensure a substantially complete cooling of the thermoplastic resin sheet transferred onto the matrix on the platen which then approaches the operated position past the transfer station, the thermoplastic resin sheet may further be cooled by the application of a cooled air cascading from above.

In the practice of the method of the present invention, since the matrix is transported to the transfer station without being bent or curved on one hand and the plasticized thermoplastic sheet is pressed against the matrix while the thermoplastic resin sheet is curved as applied on the outer peripheral surface of the press roll on the other hand, the thermoplastic resin sheet can penetrate deep into the indentations or cavities in the matrix at the transfer station as if a glue or caulking material were forced to fill up gaps or voids by the application of a spatula. The result is that the method of the present invention makes it possible to provide a thermoplastic duplication plate capable of achieving reliable reproduction of print details. Moreover, the subsequent processing, such as trimming, can readily be performed subject to the duplication plate manufactured by the method of the present invention and, therefore, the duplication plate satisfying the dimensional requirements within a tolerable range can readily be obtained.

Furthermore, since the duplication plate is made of the thermoplastic resin material, the duplication plate which has become unnecessary and, therefore, rejected, can be recycled for the production of another duplication plate, making a contribution to reduction of the manufacturing cost of the duplication plate.

These and other objects and features of the present invention will readily become apparent from the following description taken in conjunction with a preferred embodiment thereof with reference to the accompanying drawing which illustrates a schematic side sectional view of a duplication plate making apparatus utilizable in the practice of the method of the present invention.

Referring to the accompanying drawing, there is schematically illustrated an apparatus for manufacturing a thermoplastic duplication plate, which apparatus is advantageously utilized in the practice of the method of the present invention. The apparatus is shown to comprise a preheating furnace 1; a conveyor 3 extending through the preheating furnace 1 for successively transporting thermoplastic resin sheets 2 one at a time from a sheet supply unit 12 onto a press roll 4 and, particularly, towards a feed gap defined between the press roll 4 and a feed roll 5; a heating unit 6 positioned adjacent the outer peripheral surface of thepress roll 4 for heating the thermoplastic resin sheets successively transported by the press roll 4 in a manner as will be described later; a water-cooled platen 8 reciprocally movably supported on a machine bench B for linear movement between first and second positions and having a perforated flat support surface for the support of a paper matrix thereon, it being understood that the perforations in the flat support surface of the watercooled platen 8 are communicated to a suitable source of vacuum (not shown) through the interior of said platen 8 by way of a suitable flexible tubing (not shown) so that the paper matrix having a relief pattern can be held flat agasint the support surface by the effect of a suction force; and a finishing roll 10.

The apparatus is shown to further comprise a cooling hood **9*a* suspended over the platen 8, then held in the first position as shown, for uniformly applying a cooling air, fed from a source of cooling air (not shown), over the paper matrix 7 on the platen 8 in the first position to cool the paper matrix 7; and ejector unit 11 for separating from the paper matrix 7 on the platen 8 the thermoplastic resin sheet which has been pressed against and then transferred onto the paper matrix 7; and a cooling hood 9*b* suspended over the ejector unit 11 for cooling the resultant duplication plate, that is, the thermoplastic resin sheet which has been separated from the paper matrix on the platen 8** then held in the second position, by the application of a cooling air fed from the common source of cooling air.

It is to be noted that the press roll 4 is preferably of a construction having an internal hollow through which hot air can be circulated for heating said press roll 4. alternatively, the press roll 4 may have a built-in heater substantially composed of a plurality of heating elements embedded in the press roll 4 in such a manner as equally spaced from each other adjacent the outer peripheral surface of said press roll 4. In any event, the temperature attained by the press roll 4 at the outer peripheral surface thereof is, in the instance as shown, selected to be of such a value that the thermoplastic resin sheet, made of, for example, polyethylene or polypropylene, can be softened in contact with the outer peripheral surface of the press roll 4 to such an extent as to cling to said outer peripheral surface thereof.

It is also to be noted that the heating unit 6 may be of a construction having one or more far infrared lamps for radiating far infrared heating energies necessary to heat, in combination with the heat energies transmitted to the thermoplastic resin sheet from the press roll being rotated, the same thermoplastic resin sheet to a temperature sufficient to allow said thermoplastic resin sheet to become pliable or substantially melt while it still clings to the outer peripheral surface of the press roll 4 being rotated. In any event, should the thermoplastic resin sheet clinging to the outer peripheral surface of the press roll 4 being rotated be heated to such a temperature by a single heating device, heating either by means of the heating unit 6 or by means of the hot air or the built-in heater may not be necessary.

The preheating furnace 1 may not be always necessary. However, the employment of the preheating furnace 1 makes it possible to rotate the press roll 4 at a relatively high speed since the thermoplastic resin sheet has been preheated to such a temperature as to enable the thermoplastic resin sheet to be readily softened in subsequent contact with the outer peripheral surface of the press roll 4.

The duplication plate making method of the present invention is practised in the following manner with the apparatus of the construction so far illustrated.

The thermoplastic resin sheet 2 shown as being transported towards the feed gap by the conveyor 3, which is shown as constituted by a belt of parallel conveyance rolls, has been fed from the sheet supply unit 12. The sheet supply unit 12 may be of any known construction and, so far illustrated, may be composed of a vertically movable tray, carrying a stack of thermoplastic resin sheets of equal and predetermined size mounted thereon, and a known suction feeder by which the thermoplastic resin sheets are successively fed onto the conveyor 3 one at a time while the tray is stepwisely upwardly shifted. The conveyor 3, although shown as constituted by a belt of parallel conveyance rolls, may alternatively be constituted by a substantially endless metallic conveyance belt.

Some or all of the conveyance rolls constituting the conveyor 3 are driven by any suitable source of driving force and, therefore, the thermoplastic resin sheet can be moved from a position adjacent the supply unit 12 towards the feed gap defined between the feed roll 5 and the press roll 4 within the preheating furnace 1 which extends from said position adjacent said supply unit 12 to the position immediately preceding the feed gap. The gap between the feed roll 5 and the press roll 4 extends in a ribbon-like form in parallel relation to the axis of rotation of the press roll or the feed roll and has a gap size so selected that, when the thermoplastic resin sheet 2 so transported enters the feed gap and as it passes therethrough, the preheated thermoplastic resin sheet can be forced to contact the outer peripheral surface of the press roll 4. Upon contact of the thermoplastic resin sheet to the outer peripheral surface of the press roll 4, the thermoplastic resin sheet clings thereto since the press roll 4 is heated as hereinbefore described.

It is to be noted that the velocity of transportation of the thermoplastic resin sheet 2 from that position towards the feed gap and the 'preheating' temperature within the preheating furnace 1 are, in the case where the thermoplastic resin sheet to be treated is made of polypropylene, preferably about 6 meters per minute and within the range of from 110° to 150° C., respectively. In practice, either of the transportation velocity and the preheating temperature may be determined in consideration of the other and the both are determined in consideration of the type of material for the thermoplastic resin sheet to be treated.

As the press roll 4 is further rotated in one direction, the thermoplastic resin sheet clinging to the outer peripheral surface of said press roll being rotated is transported, in such a manner as indicated by 2' in the accompanying drawing, towards a transcription clearance through a heating zone defined between the press roll 4 and the heating unit 6. During the passage of the thermoplastic resin sheet 2' through the heating zone, the thermoplastic resin sheet 2' is substantially fused by combined heat energies from the press roll 4 and the heating unit 6 while it still remain clinging to the outer peripheral surface of the press roll 4.

It is to be noted that, if a difference in temperature between the press roll 4, more specifically, the outer peripheral surface of said press roll 4, and the heating unit 6 is considerable due to, for example, the lower temperature setting of the press roll relative to the temperature emitted from the heating unit 6, not only does the thermoplastic resin sheet 2' being passed through the heating zone be required to be heated a longer period of time than where the temperature difference is small, but also an unfavorable contact of the thermoplastic resin sheet 2' with the outer peripheral surface of the press roll 4 be invited. In view of this, in order to achieve an optimum condition in which the thermoplastic resin sheet 2' is substantially fused uniformly while it still remains clinging to the outer peripheral surface of the press roll with no void and/or blowhole being substantially developed at the contact area between the thermoplastic resin sheet and the outer peripheral surface of the press roll 4, the press roll 4, more specifically, the outer peripheral surface of the press roll 4, is to be heated to and maintained at a predetermined temperature, preferably not less than about 130° C.

The transcription station referred to above is defined immediately below the press roll 4 and above the machine bench B and is where the substantially fused thermoplastic resin sheet so transported by the press roll 4 past the heating zone is transferred onto the matrix 7 on the water-cooled platen 8 being moved from the first position towards the second position while penetrating deep into the indentations or cavities in the paper matrix 7, which indentations or cavities altogether constitute the relief pattern on the paper matrix 7.

In order for either the thermoplastic resin sheet transported by the press roll 4 in the manner as hereinbefore described or the paper matrix 7 transported by the water-cooled platen 8 to be registered or aligned with the other at the transcription station in readiness for the expected transfer of the thermoplastic resin sheet onto the paper matrix, the rotation of the press roll 4 and the movement of the platen 8 must be so synchronized that the leading end of the thermoplastic resin sheet with respect to the direction of rotation of the press roll 4 can be aligned with the leading end of the paper matrix 7 with respect to the direction of movement of the platen 8 from the first position towards the second position at the transcription station. In addition, the velocity of movement of the platen 8 at least from the first position towards the second position and the peripheral velocity of the press roll 4 must be equal to each other and, preferably, within the range of from 4.5 to 8 meters per minute.

It is to be noted that the gap size of the transcription clearance as measured in terms of the most smallest possible distance between the flat support surface of the platen 8 and a point on the outer peripheral surface of the press roll adjacent said flat support surface of said platen 8 may be selected in consideration of the sum of the thickness of the paper matrix 7 employed and the means thickness of the thermoplastic resin sheet then so fused as to assume a substantially semi-fluidized state.

As the thermoplastic resin sheet being transported by the rotating press roll 4 and the paper matrix being transported by the platen 8 pass through the transcription clearance, the former separates from the outer peripheral surface of the press roll 4 and is transferred onto the paper matrix 7 being continued to move towards the second position. In order to facilitate separation of the thermoplastic resin sheet from the outer peripheral surface of the press roll 4 prior to the transfer, if desired, any suitable parting or releasing agent, such as oil or silicone, may be applied over the entire outer peripheral surface of the press roll 4. However, if the outer peripheral surface of the press roll 4 is mirror-polished as is in the instant case now under discussion, no parting agent may be employed.

During the continued movement of the platen 8 towards the second position past the transcription station, the thermoplastic resin sheet transferred onto the paper matrix 7 on the platen 8 is passed underneath the finishing roll 10 while squeezed further against the paper matrix 7 by the application of a pressing force exerted by said finishing roll 10. It is to be noted that the minimum gap size, or the smallest possible distance, between the finishing roll 10 and the flat support surface of the platen 8 is selected to be substantially equal to or slightly smaller than the gap size of the transcription clearance.

Subsequent to the squeezing which has been performed by the finishing roll 10 subject to the thermoplastic resin sheet mounted on the paper matrix 7 on the platen 8 being moved towards the second position, and as the platen 8 approaches the second position, the thermoplastic resin sheet enters below the cooling hood **9*b*** from which cooling air is applied to said thermoplastic resin sheet to forcibly cool the latter.

After the thermoplastic resin sheet mounted on the platen 8 through the paper matrix 7 has been hardened, and subsequent to arrival of the platen 8 at the second position, the thermoplastic resin sheet is separated from the paper matrix 7 by the ejector 11, which paper matrix 7 is still retained in positon on the flat support surface of the platen 8, it being understood that the thermoplastic resin sheet so separated from the paper matrix 7 by the ejector 11 has one surface formed with a relief image complemental in shape to the relief pattern on the paper matrix and, therefore, serves the purpose as a duplication plate. The platen 8 is, after the thermoplastic resin sheet has been separated from the paper matrix 7 by the ejector 11, returned back to the first position together with the paper matrix in readiness for the subsequent transcription process.

While the thermoplastic duplication plate making method according to the present invention is practised in the manner as hereinbefore described with the apparatus so operated, it is to be noted that the feed roll 5 is preferably heated to prevent the preheated thermoplastic resin sheet from being thermally shockened in contact with the feed roll 5 which may otherwise takes place if the feed roll 5 is not heated.

As a material for the thermoplastic resin sheet and, hence, the ultimate duplication plate, any thermoplastic resin may be employed if it has a relatively high softening point and a sufficient resistance to such an oil as contained in an ordinary printing ink and be inexpensive and capable of being recycled. However, any one of polyethylene resin and polypropylene resin is preferred as a material for the ultimate duplication plate manufactured by the method of the present invention. More preferred is the polypropylene resin because of its physical strength sufficient to withstand severe conditions which the ultimate thermoplastic duplication plate may receive when used as a printing plate in a rotary press for printing a large number of copies of newspaper from a single printing plate.

More specifically, in view of the fact that any of the polyethylene resin and the polypropylene resin has numerous types which exhibit different fluidity, when heated to fuse, due to difference in degree of polymerization and/or molecular weight, one or more polyethylene or polypropylene resins which exhibit a melt flow rate within the range of from 3 to 10 at such a temperature as attained during the transcription process may preferaby and advantageously be employed as a material for the ultimate thermoplastic duplication plate in consideration of availability of reliable reproduction of print details and also of "recycleability", that is, capability of being recycled for the subsequent production material.

The size and thickness of the thermoplastic resin sheet to be treated may be selected depending upon the purpose for which the ultimate duplication plate is used and/or the type of paper matrix used therewith. However, where the paper matrix used tends to exhibit reduction in workability upon repeated application of loads thereto from the press roll 4 through the thermoplastic resin sheet during the passage thereof through the transcription clearance, the thermoplastic resin sheet to be treated may have a thickness, varying in a predetermined gradient, over the entire length thereof. The employment of the thermoplastic resin sheet of varying thickness described above provides such an additional advantage that the duplication plate having a more uniform thickness over the entire length thereof can be available. A similar advantage can be appreciated even if a plurality of holes or recesses are formed in the thermoplastic resin sheet. In any event, the present invention will now be described by way of example.

EXAMPLE I

Manufacture of Thermoplastic Resin Sheet

By the use of a known plastic extrusion machine having a hopper and an outlet slit, polypropylene resin (having a melt flow rate of eight) was introduced in a powdery form into the machine through the hopper and heated at 220° C. to melt. During passage within the extrusion machine towards the outlet slit, the melted polypropylene resin was stirred and, after having been degasified to avoid any possible containment of bubbles and/or blowholes in the ultimate polypropylene resin sheet, extruded through the outlet slit to produce the polypropylene resin sheet of 1.2 mm. in thickness. The polypropylene resin sheet so produced was cut to a predetermined size.

Manufacture of Duplication Plate

With the use of the polypropylene resin sheet, a polypropylene duplication plate was manufactured with the illustrated apparatus operated under the following conditions.

Preheating Furnace (with hot air circulation)
Preheating Temp.: 200° C. (Temp. attained by Resin Sheet: 140° C.)
Transportation Velocity: 6 m/min.
Press Roll (heated by hot air circulation)
Peripheral Velocity: 6 m/min.
Outer Surface Temp.: 170° C.
Feed Roll (heated by hot air circulation)
Outer Surface Temp.: 100° C.
Heating unit (by the application of hot air)
Hot Air Temp.: 350° C.
Type of Paper Matrix
"Non-Pack Mat"; 1.5 mm. in thickness and having a special coating applied.
Water-Cooled Platen
Support Surface Temp.: 5 to 10° C.
Transportation Velocity: 6 m/min.
Cooling Hoods 9a and 9b
Temp. of Cooling Air Applied: 5 to 10° C.
Finishing Roll
Heated by hot water circulation to 50° C.
Transcription Clearance: 1.65 mm. in gap size
Finishing Gap: 1.60 mm. in gap size The resultant thermoplastic duplication plate when used as a printing plate in a rotary press has exhibited a reliable reproduction of print details comparable with that afforded by the conventional metal printing plate. The thermoplastic duplication plate used in printing for the purpose of the present invention was thereafter pulverized for the subsequent production material.

EXAMPLE II

With the use of the polypropylene resin sheet manufactured as under Example I above, a polypropylene duplication plate was manufactured with the apparatus operated under the conditions as set forth in Example I except for the heating unit 6 comprised of nine infrared lamps of 1 Kw. The resultant polypropylene resin sheet was similar in characteristic to that in Example I.

EXAMPLE III

With the use of the polypropylene resin sheet manufactured as under Example I above, a polypropylene duplication plate was manufactured with the apparatus operated under the condition as set forth in Example I except for the preheating temperature being set to 140° C. and the heating unit 6 comprised of eighteen infrared lamps of 1 Kw. The resultant polypropylene resin sheet was similar in characteristic to that in Example I.

Although the present invention has fully been described by way of the preferred embodiment thereof with reference to the accompanying drawing, it is to be noted that various changes and modifications are apparent to those skilled in the art. For example, the matrix having been described as made of paper material may be made of plastic material or metallic material. Such changes and modifications are, therefore, to be understood as included within the true scope of the present invention.

What is claimed is:

1. A method of manufacturing a thermoplastic duplication plate having a relief image formed at one surface thereof, which comprises:

feeding a thermoplastic resin sheet of a predetermined size onto a hollow cylinder of a type supported in position for rotation in one direction about the longitudinal axis thereof and having temperature-adjustable heating means for heating the cylinder to a predetermined adjustable temperature, said cylinder during each complete rotation thereof passing a receiving station, at which said thermoplastic resin sheet is mounted on the outer peripheral surface of said cylinder, and a transcription station spaced a predetermined angular distance from said receiving station;

causing said thermoplastic resin sheet to cling to the outer peripheral surface of the cylinder, upon contact of said thermoplastic resin sheet with said outer peripheral surface of said cylinder and as said cylinder during rotation thereof passes said receiving station, thereby transporting said thermoplastic resin sheet towards the transcription station by means of said cylinder;

heating said thermoplastic resin sheet on said cylinder by means of the temperature-adjustable heating means during the transportation of said thermoplastic resin sheet from said receiving station towards said transcription station to a point where said thermoplatic resin sheet becomes substantially semi-fluidized;

separately transporting a paper matrix, having a relief pattern complemental in shape to the relief image on the ultimate duplication plate towards the transcription station by means of a cooled carriage of a type supported in position for linear movement in a direction transversely of the imaginary plane passing through the longitudinal axis of said cylinder between first and second positions, said carriage having a flat support surface for the support of said matrix thereon and being moved from said first position towards said second position during the transportation of said matrix towards said transcription station;

registering said thermoplastic resin sheet, carried by said cylinder during the continued rotation thereof, with said matrix at said transcription station;

causing the substantially semi-fluidized thermoplastic resin sheet to penetrate into indentations in said matrix, which indentations define said relief pattern on said matrix, and then transferring said semi-fluidized thermoplastic resin sheet onto said matrix as said thermoplastic resin sheet and said matrix move past said transcription station in synchronized relation with each other;

cooling the thermoplastic resin sheet which has been transferred onto said matrix on said carriage; and separating the cooled thermoplastic resin sheet from said matrix, thereby completing the thermoplastic duplication plate.

2. A duplication plate manufacturing method as claimed in claim 1, further comprising a step of preheating said thermoplastic resin sheet, which preheating is effected prior to said thermoplastic resin sheet mounted on the outer peripheral surface of said cylinder to a predetermined temperature lower than the temperature of said cylinder.

3. A duplication plate manufacturing method as claimed in claim 1, wherein there is further provided a feed roll positioned at the receiving station in parallel relation to the longitudinal axis of said cylinder and spaced a predetermined distance from the outer peripheral surface of said cylinder, and wherein said thermoplastic resin sheet is caused to cling to the outer peripheral surface of said cylinder during the passage thereof through a clearance defined between said feed roll and said cylinder.

4. A duplication plate manufacturing method as claimed in claim 1, further comprising a step of pressing the thermoplastic resin sheet by passing said thermoplastic resin sheet, which has been transferred to said matrix on said carriage, through a gap between said flat support surface of said carriage during the continued movement thereof towards said second position, said pressing step being effected subsequent to said causing and transferring step.

5. A duplication plate manufacturing method as claimed in claim 1, wherein the thermoplastic resin sheet is additionally heated, to facilitate the substantial semi-fluidization thereof in combination with the heat energies emitted by the cylinder, by a heating unit positioned externally of said cylinder and between said receiving station and said transcription station with respect to the direction of rotation of the cylinder.

6. A duplication plate manufacturing method as claimed in claim 1, wherein said matrix is firmly supported on said flat support surface of said carriage by the effect of suction force.

7. A duplication plate manufacturing method as claimed in claim 1, wherein said carriage is of water-cooled construction and wherein said matrix on said flat support surface of said carriage is cooled in contact with said flat support surface during the movement of said carriage from said first position to said second position to a predetermined temperature.

8. A duplication plate manufacturing method as claimed in claim 1, wherein said transfer of the thermoplastic resin sheet from the cylinder onto the matrix is effected by a temperature difference between said outer peripheral surface of said cylinder and said matrix.

9. A duplication plate manufacturing method as claimed in claim 1, wherein the outer peripheral surface of the cylinder is applied with a parting agent for facilitating the separation of the thermoplastic resin sheet onto the paper matrix on the carriage.

* * * * *